US007909164B2

(12) United States Patent
Andrews et al.

(10) Patent No.: US 7,909,164 B2
(45) Date of Patent: Mar. 22, 2011

(54) NESTABLE LID FOR PACKAGING SYSTEMS

(75) Inventors: Alan Andrews, Mundelein, IL (US); David Furstoss, Gurnee, IL (US)

(73) Assignee: Pactiv Corporation, Lake Forest, IL (US)

( * ) Notice: Subject to any disclaimer, the term of this patent is extended or adjusted under 35 U.S.C. 154(b) by 941 days.

(21) Appl. No.: 11/098,044

(22) Filed: Apr. 1, 2005

(65) Prior Publication Data

US 2006/0219594 A1 Oct. 5, 2006

(51) Int. Cl.
*B65D 81/02* (2006.01)
*B65D 85/32* (2006.01)

(52) U.S. Cl. ..... 206/521.1; 206/521.15; 206/521.8; 206/585

(58) Field of Classification Search ..... 206/521.1, 206/585, 564, 509, 521.15, 521.2–521.9
See application file for complete search history.

(56) References Cited

U.S. PATENT DOCUMENTS

| | | | | |
|---|---|---|---|---|
| 2,066,587 | A | 1/1937 | Swift, Jr. | 217/26.5 |
| 2,100,516 | A * | 11/1937 | Read | 206/521.8 |
| 2,160,893 | A * | 6/1939 | Newsom | 206/521.8 |
| 2,655,305 | A | 10/1953 | Schilling | 229/44 |
| 2,815,162 | A * | 12/1957 | Grant | 206/521.8 |
| 2,885,136 | A | 5/1959 | Grant | 229/2.5 |
| 2,950,726 | A | 8/1960 | Kuhl et al. | 134/194 |
| 3,269,634 | A * | 8/1966 | Mers | 206/521.8 |
| 3,451,577 | A * | 6/1969 | Nurick | 217/26.5 |
| 3,568,914 | A | 3/1971 | Ahlmeyer | 229/44 |
| 3,661,317 | A * | 5/1972 | Noguchi | 206/521.1 |
| 3,675,806 | A * | 7/1972 | Noguchi | 217/26.5 |
| 3,817,441 | A | 6/1974 | Jackson | 229/2.5 |
| 3,877,599 | A * | 4/1975 | Morris | 217/26.5 |
| 4,057,188 | A * | 11/1977 | Steinhardt | 206/521.8 |
| 4,361,263 | A | 11/1982 | Thomas | 229/2.5 |
| 4,625,905 | A | 12/1986 | Mangla | 229/2.5 |
| 4,742,952 | A * | 5/1988 | Bixler et al. | 229/125.36 |
| 4,795,080 | A * | 1/1989 | McIntyre | 206/521.1 |
| 5,102,034 | A * | 4/1992 | Amabili | 206/521.1 |
| 5,538,136 | A * | 7/1996 | Onneweer | 206/521.8 |
| 6,276,531 | B1 * | 8/2001 | Andrews | 206/521.1 |

FOREIGN PATENT DOCUMENTS

| | | |
|---|---|---|
| FR | 1047491 | 12/1953 |
| WO | WO 87/02336 | 4/1987 |

* cited by examiner

*Primary Examiner* — Mickey Yu
*Assistant Examiner* — Sharon M Prange
(74) *Attorney, Agent, or Firm* — Baker Botts LLP

(57) ABSTRACT

Nestable packaging lids are described. Generally, the packaging lids include a generally planar lid member having an upper surface and a lower surface, a plurality of dome expansions extending upwardly from the lid member, and a plurality of elongate projections extending downwardly from the lower surface of the lid member. Each dome expansion defines a downwardly facing recess and includes a base perimeter defining a base center, and the dome expansions are arranged in longitudinal rows and transverse columns. In an implementation, at least one projection is disposed transversely between a longitudinally adjacent pair of dome expansions and at least one projection is disposed longitudinally between a transversely adjacent pair of dome expansions.

25 Claims, 3 Drawing Sheets

NESTABLE LID FOR PACKAGING SYSTEMS

TECHNICAL FIELD

The present invention generally relates to a lid for an egg tray packaging system. Particularly, in a preferred embodiment, the invention is a polystyrene dome lid having a plurality of dome expansions and projections configured for use with a molded fiber egg tray or other material tray. The lid functions to securely hold eggs or similar items that have been loaded within the tray, and to accommodate a wrap material or other method for packaging and shipment.

BACKGROUND OF THE INVENTION

Conventional egg and fruit trays, and the contents therein, often encounter significant breakage and/or damage during delivery and storage. Care must be exercised in the collecting, processing, and handling to prevent damage to the fruits, vegetables and other food items including eggs.

The majority of fresh eggs sold in the United States are sold in 12 count and 18 count egg cartons through the retail grocery channel. However, large volumes of eggs and similar items have become more popular to consumers, resulting in a need for larger packages that can hold increased quantities of eggs to be sold by traditional grocery stores and other retail outlets. Thus, in order to stay competitive, grocers and warehouse retailers now require larger package sizes for eggs and other produce (e.g. eighteen (18) count egg tray containers and higher), but do not have a large floor area for storage and/or display. Many stores use molded fiber trays (known as "filler flats") and single faced corrugated sleeves to accommodate large volumes of items. For example, such assemblies can be used for a 30 count package, or a 36 count package. The retailers stack several egg trays which can be insecure and unstable if not stacked properly. In addition, conventional egg packaging systems do not nest within each other, and thus a large volume of retail space may be required to display and store the egg trays.

It is also preferable to provide a system that prevents tampering of the items contained therein. For example, conventional packaged egg containers can be opened in a retail environment by consumers, which exposes the eggs to breakage.

U.S. Pat. No. 6,276,531, which is incorporated in its entirety by reference herein, discloses a molded fiber nestable egg tray packaging system that includes a transparent lid. The transparent lid includes upwardly extending conical shaped elements and a downwardly shaped rim having notches that assist in securing the lid to a filler flat. A shrink film band is placed around the filler flat with lid applied to secure the lid during handling and make the finished product "tamper evident". The transparent lid provides lateral stability for trays when stacked, and avoids the increasing cost that results from the eggs being damaged or broken. Although the nestable egg tray packaging system disclosed by this patent is a significant advance in the field of packaging systems, when used in a display the transparent lid may cause a consumer to reject an entire egg tray package because one egg visible through the lid appears to contain a minor defect. In addition, transparent lids can be relatively expensive to manufacture.

Accordingly, it is desirable to produce a low cost, secure and stable egg tray system that overcomes the shortcomings of the prior art, while still accommodating an increased amount of eggs that can be safely and securely stacked and stored.

SUMMARY OF THE INVENTION

Nestable packaging lids for mating with conventional packaging trays to hold items therebetween, and which can be provided at low cost, are described herein. The packaging lids according to the invention can be used to form packaging systems that have improved item security and stacking characteristics.

Generally, each of the disclosed packaging lids includes a generally planar lid member having an upper surface and a lower surface, a plurality of dome expansions extending upwardly from the lid member, and a plurality of elongate projections extending downwardly from the lower surface of the lid member. Each dome expansion defines a downwardly facing recess and includes a base perimeter defining a base center, and the dome expansions are arranged in longitudinal rows and transverse columns. In addition, at least one projection is disposed transversely between a longitudinally adjacent pair of dome expansions and at least one projection is disposed longitudinally between a transversely adjacent pair of dome expansions.

In accordance with an aspect of the invention, each projection has a varied width, the width of the projection increasing with increasing distance from the midpoint. In a beneficial implementation, each projection has a height of between about one-sixteenth of an inch and about one-quarter of an inch, and the height of the projection varies along the length of the projection. A support area is defined on the lower surface of the lid member between diagonally adjacent pairs of dome expansions, and the support area is free of projections. The plurality of projections are disposed between each pair of adjacent dome expansions and between each pair of adjacent dome expansions in each transverse column. In a preferred embodiment, each dome expansion includes a frustoconical-shaped extension disposed on a top portion. The dome expansion includes a first opening angle at the base perimeter and the frustoconical-shaped extension includes a second opening angle, wherein the first opening angle is different than the second opening angle. In addition, the frustoconical-shaped extension has at least one of a flat top surface or a concave top surface.

Another aspect according to the invention pertains to a packaging system. In a preferred embodiment, the packaging system generally includes a nestable packaging lid and a nestable packaging base. The nestable packaging lid includes a generally planar lid member having an upper surface and a lower surface, a plurality of dome expansions extending upwardly from the lid member, and a plurality of elongate projections extending downwardly from the lower surface of the lid member. Each dome expansion defines a downwardly facing recess and has a base perimeter and a base center, the dome expansions being arranged in longitudinal rows and transverse columns. At least one projection is disposed transversely between a longitudinally adjacent pair of dome expansions and at least one projection is disposed longitudinally between a transversely adjacent pair of dome expansions. The nestable packaging base includes a base member having an upper surface and a lower surface, a plurality of pockets defined in the base member, and a plurality of posts extending upwardly from the base member. Each pocket is disposed for alignment with a corresponding dome expansion of the nestable packaging lid, and each post is disposed between a diagonally adjacent pair of pockets, the posts configured to support the nestable packaging lid.

In an advantageous embodiment, the nestable packaging lid of the packaging system also includes a support area defined on the lower surface of the lid member between diagonally adjacent pairs of dome expansions that is free of projections and aligned to receive a top surface of a corresponding post of the nestable packaging base. In a preferred embodiment, a wrap material is used to surround and secure the nestable packaging lid and the nestable packaging base together.

These and other features of the disclosed nestable lids of the present invention can be more fully understood by referring to the following detailed description and accompanying drawings. The drawings are not drawn to scale, but show only relative dimensions.

BRIEF DESCRIPTION OF THE DRAWING FIGURES

Other objects and advantages of the invention will become apparent upon reading the following detailed description of illustrative embodiments and upon reference to the drawings, wherein.

DETAILED DESCRIPTION OF THE PREFERRED EMBODIMENTS

Figure 1:
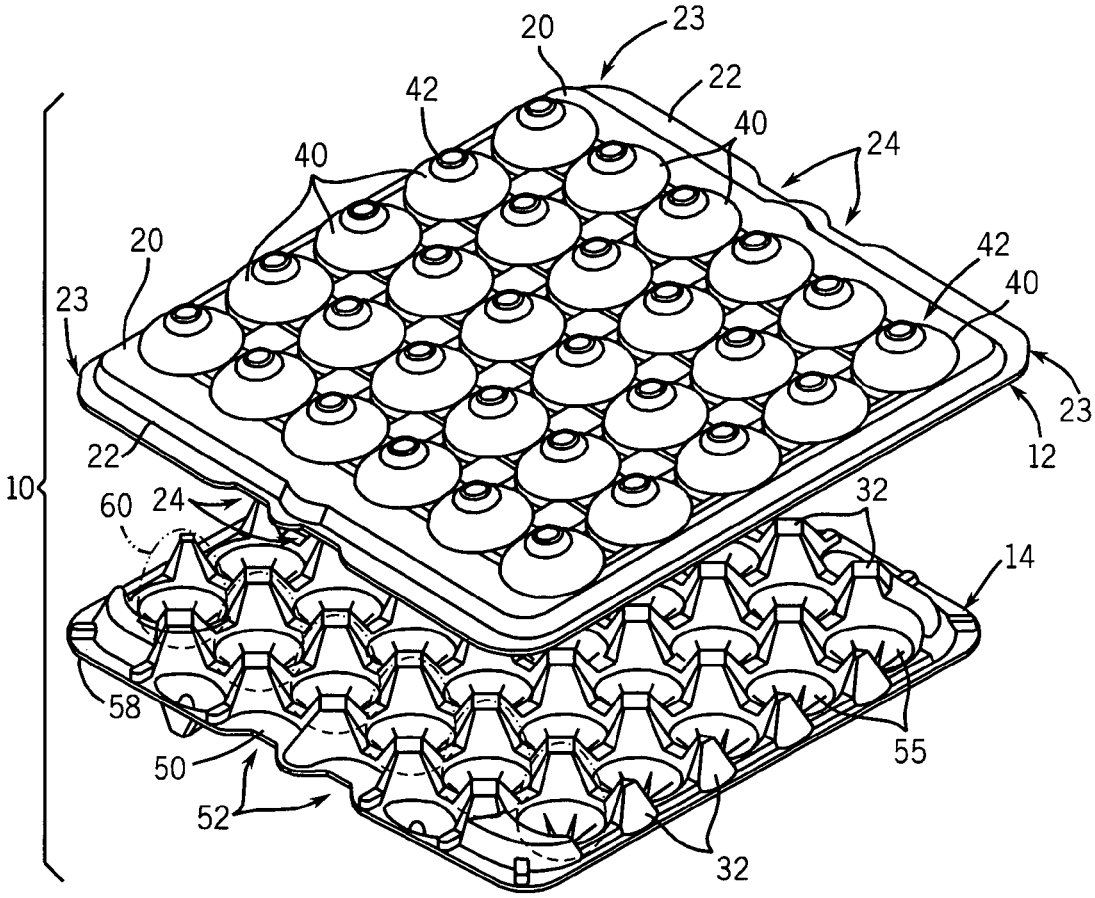
FIG. 1 is a perspective, exploded view of an egg packaging tray system that includes a packaging base and a nestable egg tray lid according to the invention.

Illustrative embodiments will now be described to provide an overall understanding of the disclosed nestable lids for a packaging system. One or more examples of the illustrative embodiments are shown in the drawings. Those of ordinary skill in the art will understand that each disclosed nestable lid can be adapted and modified to provide alternative embodiments of nestable lids for other applications, and that other additions and modifications can be made to the disclosed nestable lids without departing from the scope of the present disclosure. For example, features of the illustrative embodiments can be combined, separated, interchanged, and/or rearranged to generate other embodiments. Such modifications and variations are intended to be included within the scope of the present disclosure.

In accordance with the present invention, a nestable packaging lid is provided alone or in combination with a nestable packaging base. The nestable packaging lid includes a generally planar lid member having an upper surface and a lower surface. A plurality of dome expansions extend upwardly from the lid member, with each dome expansion defining a downwardly facing recess. Each dome expansion is sized and shaped to receive at least the upper portion of an item to be contained therein. Each dome expansion further includes a base perimeter defining a base center.

For purpose of illustration, and not limitation, reference is made to the representative embodiment depicted herein. Particularly, FIG. 1 is a perspective, exploded view of a packaging system 10 that includes a nestable packaging lid 12 and a nestable packaging base or filler flat 14. Although the figures depict an egg tray system, it is to be understood that the packaging system of the present invention is suitable for or can be modified to accommodate any of a variety of other items, such as fruit, vegetables, produce and/or other food or fragile items.

The packaging lid 12 embodied herein includes a rectangular-shaped, generally planar lid member 20. A plurality of dome expansions 40 extend upwardly from the upper surface of the lid member. As embodied herein, the plurality of dome expansions are arranged in longitudinal rows and transverse columns. For purposes of eggs, each dome expansion has a generally semi-spherical or parabolic shape, although alternate shapes can be used for alternate items. The dome expansion 40 thus defines a downwardly facing cavity for providing a secure housing at least for an upper portion of an egg.

In this embodiment, thirty dome expansions 40 (six dome expansions disposed in each of five rows) protrude from the lid member 20. If desired, however, the packaging system can be provided with a different capacity for holding fewer or more items by providing a corresponding number of dome expansions 40. The packaging system 10 can be designed to include, for example, four, six, twelve, eighteen, twenty, twenty-four or thirty-six conical dome expansions and would thus house a corresponding number of items, although a multiple of 5 or 6 is preferred. Similarly, a variety of different configurations are possible for the tray system. For example, an egg tray system having a capacity of 24 eggs can be configured to have 4 rows of 6 eggs each, or 3 rows of 8 eggs each. As further evident in FIG. 3A along line D-D, the dome expansions need not be aligned exactly along a row or column. For example, the dome expansions could be staggered, or the dome expansions could be formed in a radial arrangement on a circular member, if desired.

Figure 2:
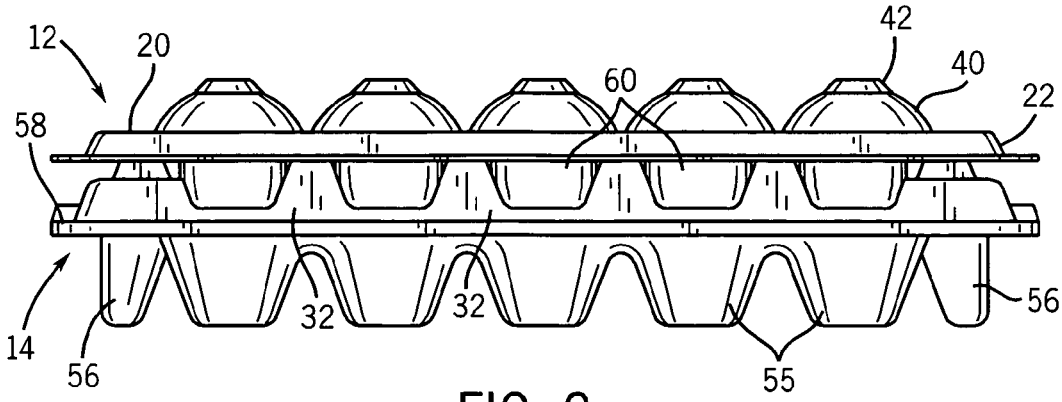
FIG. 2 is a side view of the nestable egg tray lid according to the invention resting on eggs and the packaging base of FIG. 1.

In accordance with another aspect of the invention, a frustoconical-shaped extension is disposed on a top portion of each dome expansion. As depicted in FIGS. 1 and 2, the extension 42 is located centrally on each dome expansion. In a preferred embodiment, and as depicted in FIGS. 2 and 3B, each dome expansion 40 has a first opening angle 40*a* at the base perimeter and the frustoconical-shaped extension 42 includes a second opening angle 42*a*. The first opening angle 40*a* is different than, and preferably greater than, the second opening angle 42*a*. Furthermore, the frustoconical-shaped extension preferably has either a flat or concave top surface 44. In this manner, the top surface 44 of the frustoconical extensions 42 on the plurality of dome expansions 40 define a generally planar top upon which another packaging system of the present invention can be supported or stacked. The frustoconical shape of the extension 42 also provides a structural enhancement and maintains a spaced relationship between the top surface 44 of the extension and the item contained within the dome expansion. Hence, the contained item is further protected against any crushing or damage that may result when pressure is applied to the top surface 44 of the extension 42.

As further depicted in FIG. 1, a rim 22 extends from a periphery of the lid member 20. In a preferred embodiment, the rim 22 extends from each side of the lid member. At least one recess 24 is formed in the edge of the rim 22 to define a handle or finger slot for the user. Preferably, and as depicted, a pair of recesses 24 are formed on opposing sides of the rim 22. The recesses 24 provide ergonomic space to grasp the packaging system 10 for packing, shipping and display. In addition, a corner diagonal feature 23 (see also FIG. 3A) is included in each corner of the rim 22. The corner diagonal features 23 function to create space when several packaging systems are stacked in a box to permit a person to insert his fingers to lift the packaging systems out of the box.

In a preferred embodiment, the packaging lid 12 is made of molded fiber or a polymeric foam, such as expanded polystyrene or a similar material that is lightweight, durable, and somewhat flexible. The egg tray lid 12 may be white or may be a variety of other colors. Alternately, the egg tray lid 12 may be made of a translucent or transparent flexible material. Any conventional method known in the art could be used to form the packaging lid 12, such as thermal forming or molding.

As previously noted, and further in accordance with the invention, the packaging system further comprises a nestable packaging base. The packaging base includes a base member having an upper surface and a lower surface, with a plurality of pockets defined in the base member. Each pocket is disposed for alignment with a corresponding dome expansion of the nestable packaging lid. Furthermore, a plurality of posts extend upwardly from the base member to support the nestable packaging lid, and in an implementation each post is disposed between a diagonally adjacent pair of pockets. One or more posts may also be disposed near the peripheral edge of the packaging base.

With reference to FIGS. 1 and 2, the packaging base 14 includes a base structure 50, a plurality of posts 32 and a plurality of pockets 55. Molded supports 56 may be provided that extend downwardly from the base structure 50. The plurality of pockets 55 are located within the generally horizontal base structure 50, and each pocket is designed to securely retain and hold the lower portion of the item to be contained therein, such as eggs 60. A flange 58 extends from a periphery of the base member, preferably at least from two opposing sides of the base member. Several indentations 52 are formed into two opposing sides of the base structure 50. The indentations 52 of the packaging base structure correspond to the location of the recesses 24 of the lid 12. The pockets 55 of the packaging base 14 and the dome expansions 40 of the lid 12 together form cells for holding and protecting the item therein.

It is desirable to enable several packaging tray systems of the present invention to be stacked on top of each other. The underside of each pocket of the packaging base embodied herein is therefore designed to increase the stability and security of the egg tray systems. For example, and as embodied herein, the underside of each pocket is formed to define a "t-shaped" or four-pronged form. In use, the pockets 55 of the packaging base 14 are filled with items such as eggs and the lid 12 is then placed to cover the eggs such that the recesses 24 of the rim 22 are aligned with the finger indentations 52 found in the packaging base 14. To secure the packaging lid and the packaging base together with the desired items contained therein, wrap material such as shrink wrap film or a bag (not shown) is placed about the assembly, and then heated to shrink the wrap material. This operation will be explained in more detail below.

FIG. 2 is a side view of the packaging lid 12 resting on the eggs 60 and the packaging base 14 of FIG. 1. The posts 32 of the packaging base contact support areas formed on the lower surface of the lid member 20. Particularly, and in accordance with another aspect of this invention, the packaging lid is supported such that the rim 22 of the lid is maintained in spaced relation relative to the flange 58 of the base structure 50. FIG. 2 shows that the use of the nestable lid 12 results in a compact egg tray system.

It should be understood that the packaging lid 12 could be used with a packaging base other than that shown in the figures. In addition, depending on the size of the items, such as eggs, and the type of packaging base being used, the packaging lid may not be supported by posts of the packaging base. For example, large eggs may be loaded into a packaging base that has short posts and thus the packaging lid contacts only the eggs when placed over the packaging base. If another packaging system is placed on top, then the dome expansions of the underlying packaging lid along with the eggs support the overlying packaging system. Such a configuration could be used to provide added protection when transporting the eggs on pallets, for example.

Figure 3A:
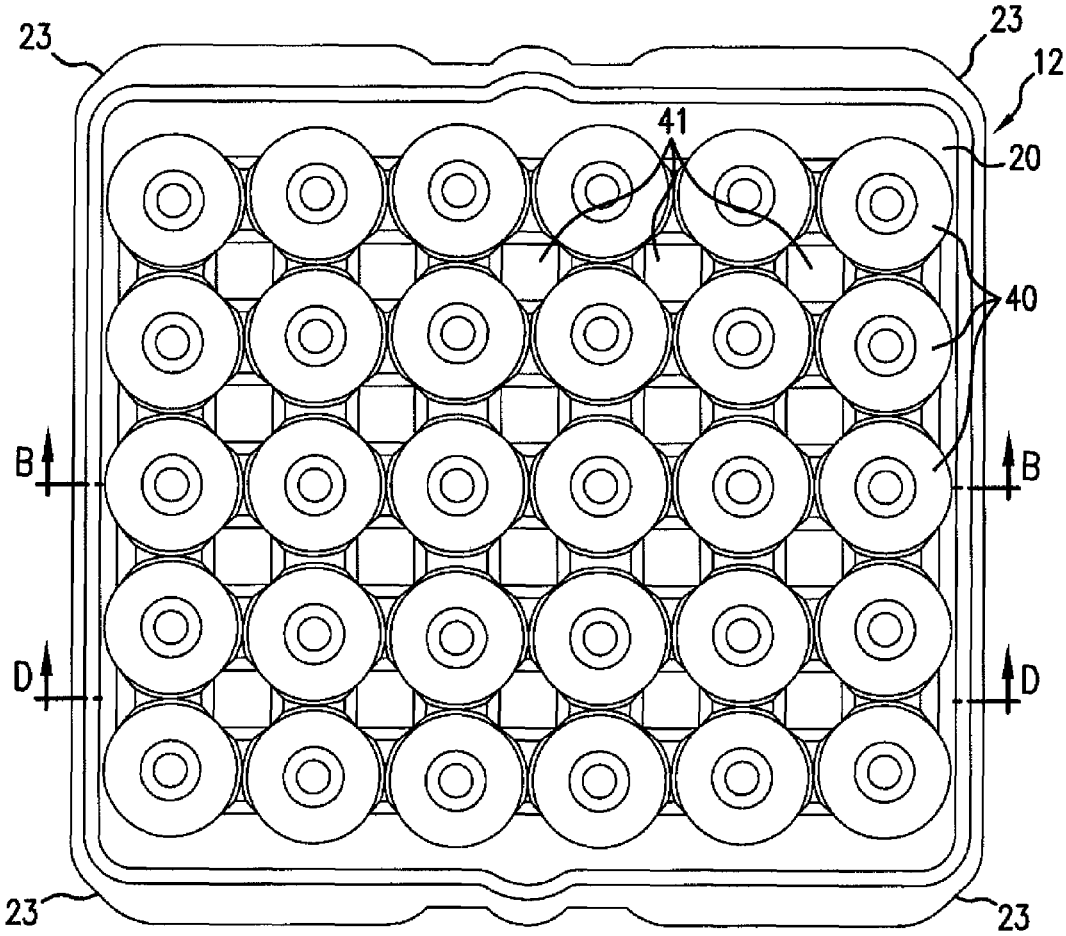
FIG. 3A is a top view of the nestable egg tray lid of FIGS. 1 and 2.
Figure 3B:
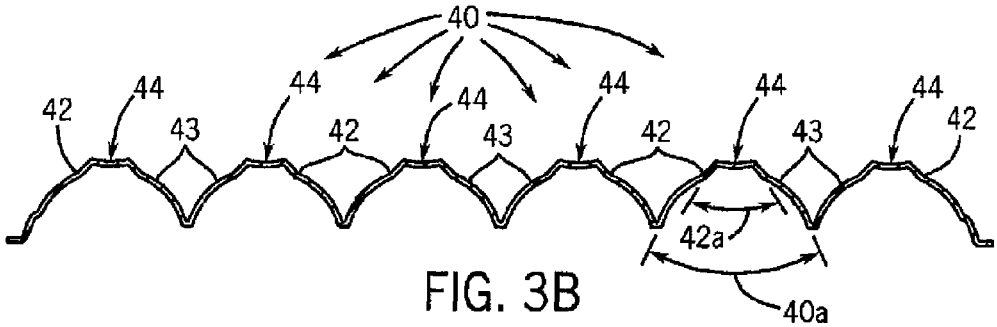
FIG. 3B is a cross-sectional view of conical dome expansions of the nestable lid taken along dotted line B-B of FIG. 3A.

FIG. 3A is a top view of the lid 12 of FIGS. 1 and 2. The support areas 41 between the dome expansions 40 are supported by underlying posts 32 of the packaging base. In a preferred embodiment, the design and shape of the packaging lid 12 allows sufficient space between the expansions 40 for corresponding pockets 55 of an overlying packaging base to nest. Thus, another packaging system can be disposed above and rotated ninety degrees respectively to the packaging system 10 having lid 12 in order to nest therewith. In this manner, a substantially square stack of egg tray systems can be formed that is suitable, for example, for loading into a full-case box or a half-case box for transport. Alternately, packaging lids according to the invention could be utilized to cover items loaded within packaging bases that are to be transported on pallets without being placed within boxes.

FIG. 3B is a cross-sectional view of the conical expansions 40 taken along the dotted lines B-B of FIG. 3A. As previously noted, each conical-shaped portion 43 of an expansion 40 preferably has a first opening angle 40*a* taken with respect to the plane of the base 20 that is different than that of a second opening angle 42*a* of the frustoconical-shaped extension 42. In addition, the top surface 44 of each extension 42 is flat or slightly concave in shape. These features of the frustoconical-shaped extensions 42 provide added strength to each dome expansion 40.

Further in accordance with the present invention, a plurality of elongate projections extend downwardly from the lower surface of the lid member. As embodied herein, at least one projection is disposed transversely between a longitudinally adjacent pair of dome expansions and at least one projection is disposed longitudinally between a transversely adjacent pair of dome expansions. Particularly, a separate projection preferably is provided between each adjacent pair of dome expansions, such that each projection has a length with its midpoint aligned generally with the base centers of the pair of adjacent dome expansions. In accordance with the invention, the width and/or the height of each projection may vary, and in a preferred embodiment the width and/or height of each projection increases with increasing distance from its midpoint. For example, each projection may have a height of between about one-sixteenth of an inch and about one-quarter of an inch that varies along the length of the projection. A support area is defined on the lower surface of the lid member between diagonally adjacent pairs of dome expansions, and in a preferred implementation the support surface is free of projections.

Figure 3D:
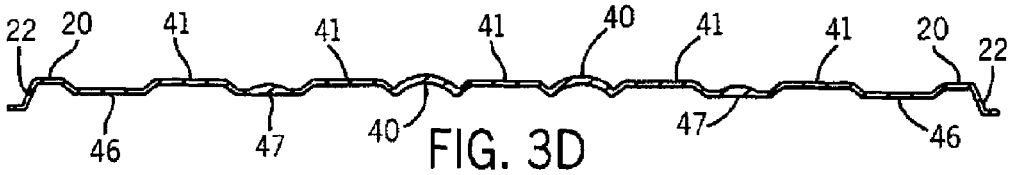
FIG. 3D is a cross-sectional view of a portion of the nestable egg tray lid taken along dotted line D-D of FIG. 3A.
Figure 3C:
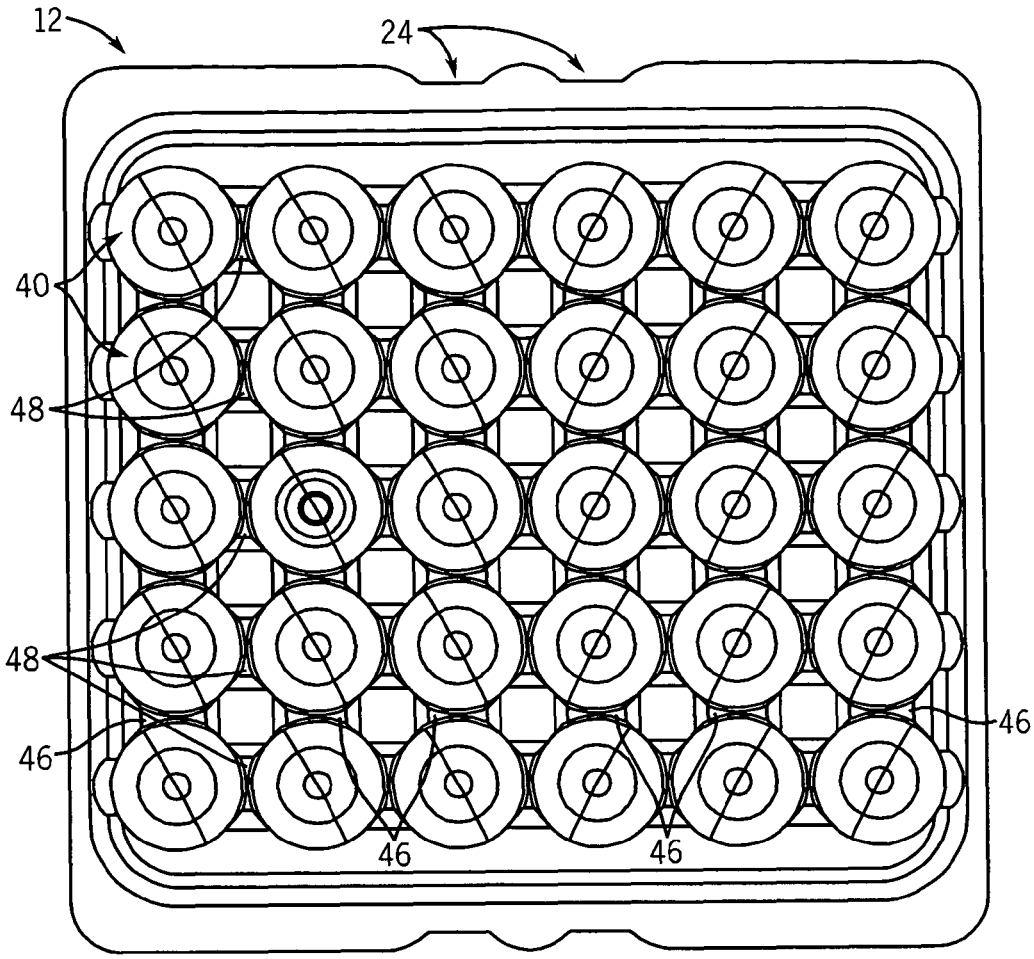
FIG. 3C is a bottom view of the nestable lid according to the invention.

FIG. 3C is a bottom view of the packaging lid 12. As embodied herein, the bottom portion of the lid 12 includes a plurality of hourglass-shaped transverse ridges or projections 46 that are located between longitudinally adjacent pairs of dome expansions 40. Similarly, the bottom portion of the lid 12 includes a plurality of longitudinal ridges or projections 48 that are located between adjacent transverse pairs of dome expansions 40. In this embodiment of a 30 count egg tray lid 12, there are four columns of transverse projections 46 and five rows of longitudinal projections 48.

FIG. 3D is a cross-sectional view of a portion of the egg tray lid 12 taken along dotted line D-D of FIG. 3A. The cross-sections of two transverse projections 46 are shown extending downwardly from the plane of the support areas 41. Also shown are the cross-sections of a part of two dome expansions 40, and cross-sectional parts 47 that include portions of a projection and a dome expansion. As embodied herein, each projection is shorter in length than the base diameter of a dome expansion, but is slightly longer than the diameter of an extension 42. In an embodiment, the projections 46 are disposed about the support areas 41 that are used to nest with the posts of the base surface 50. The support areas 41 are sized to accommodate the posts of the packaging base, and to allow some leeway for large items that may slightly deform the packaging base such that the posts are not uniformly spaced apart. The length of each projection 46 can be varied as desired. In addition, in an embodiment the width of a projection 46 increases with increasing distance or displacement from a midpoint of the length of a projection. In this manner, the transverse projections 46 and longitudinal projections 48 are contoured to prevent items, such as eggs, in adjacent pockets 55 from contacting each other during transport on pallets or in cases, so as to reduce breakage. Thus, in addition to the expansions and pockets, the projections 46 and 48 in the lid 12 function to separate and protect the items contained within the cells.

In an embodiment, after each of the pockets 55 within the packaging base 14 have been filled with the desired items, such as eggs 60, and the egg tray lid 12 has been positioned as shown in FIG. 2, the lid and packaging tray are secured together. As embodied herein, a wrap material such as a film bag or flat roll stock film can be placed around the packaging system to secure the items between the packaging base and the lid. The use of pre-printed film also allows for product identification, which is particularly enhanced when a white or light color lid is used. Once placed, the film bag or wrap sheet will ensure packaging system security by preventing the detachment of the packaging tray lid 12 from the packaging base 14 until consumption of the items is desired, as well as provide tamper-evidence.

A variety of techniques for wrapping the packaging assembly are known. For example, a shrink wrap system could be used, and is commonly used in the packaging industry. As embodied herein, after the eggs or other items have been placed within the packaging base 14 and the lid 12 has been positioned over the items, the assembly is covered or encased with a pre-printed shrink film bag. The shrink film bag and egg tray system 10 is then heated, using a heat tunnel or other techniques commonly known in the art. For example, the egg tray and eggs are subjected to heat for approximately 5 to 15 seconds before refrigeration of the eggs. Alternately, pre-printed flat roll stock shrink film can be used with an "L-Bar" sealer to encase the packaging base and lid assembly within the plastic film. In both cases, the shrink film then shrinks to compress the lid 12 to the packaging base 14 so as to cinch the lid to the packaging base. In addition, the shrink wrap film presses the dome expansions 40 downward to surround and hold the eggs in their respective cells of the egg tray system 10. This stabilizes the eggs for transport, stacking, and/or display. The dome expansions may contact the eggs contained within the cells, depending on the size and shape of the eggs. Due to the non-uniform size and shape of eggs, one or more dome expansions 40 of a particular packaging system may not fully contact or may not contact the top portion of one or more of the smaller eggs, thus allowing the smaller eggs to move about within the cells. But the transverse projections 46 and the lateral projections 48 still function to prevent each of the eggs from contacting another egg in the package.

When a shrink wrap bag or flat roll stock shrink wrap is used to seal a packaging lid 12 to a packaging base 14, the plastic material stretches between the extensions 42 of the dome expansions 40 of the lid. As described above, when a second packaging system is to be nested onto a first packaging system, the second packaging system is rotated ninety degrees with respect to the first packaging system and then placed thereon. Each pocket of the second, overlying packaging base contacts the shrink-wrap plastic material that is stretched between the dome expansions of the underlying packaging lid of the first packaging system. The extensions thus encounter a force from an overlying packaging system. The shape and disposition of a extension over the central top portion of a dome expansion evenly distributes the applied force encountered by that extension over the entire base portion of that dome expansion. Thus, the pockets of the second packaging system are partially supported by the dome expansions (by virtue of their contact with the shrink wrap film between adjacent extensions), as well as by the corresponding posts of the underlying packaging base of the first packaging system. The shape and disposition of the extensions enable the dome expansions to handle the additional weight of the second packaging tray system. When several packaging systems are stacked on top of the first packaging system, substantially all of the weight of the combined packaging systems is handled by the posts of the first packaging system, as the plastic film, in this case, is stretched to contact the support areas between the dome expansions which are supported by the underlying posts of the first packaging base. However, if a stiffer type of film, or a thicker film, is used to wrap a packaging system, then substantially all of the weight of the combined packaging systems may be distributed over the posts and the dome expansions of the first packaging base.

Pre-printed product or nutritional information could appear on the shrink film bag or on the flat roll stock shrink wrap film, which is easy to view against the light color or white background of the packaging lid. It is further contemplated that a label could be placed on the shrink film bag or wrapping film that contains product or nutritional information. Such information may printed on the top, bottom, and the sides.

It is contemplated that a stack of packaging systems 10 could be wrapped together to form a larger unit of multiple packaging systems to provide enhanced item protection. For example, a first 30 count egg packaging system could be rotated ninety degrees and stacked onto a second 30 count egg packaging system and then wrapped together to form a 60 count packaged item. In another example, a third 30 count egg packaging system could be rotated ninety degrees and stacked onto the first two packaging systems and all three wrapped together to form a 90 count packaged item. Such large count items beneficially provide enhanced protection because items contained therein are prevented from contacting each other during transporting and handling.

In another embodiment, one or more elastic band(s) can be placed between the transverse columns and/or the longitudinal rows of the dome expansions on the packaging lid to secure the packaging lid to the packaging base of the packaging system. In particular, a roll of elastic material is placed on a wrapping machine and then a full egg tray is placed on the machine. In a preferred embodiment, the elastic material is directed around the entire packaging system in both the longitudinal and transverse directions, between an outer row of the dome expansions and at least one inner row and column of dome expansions closer to the center of the packaging lid. Suitable elastic material and machines are manufactured by Delta Cyklop of Charlotte, N.C. Packaging systems secured in this manner can advantageously be stacked together very compactly, because there is no shrink wrap film in between the dome expansions to interfere with the contact of the pockets of an overlying packaging system with the support surface of the underlying packaging system.

Figure 4:
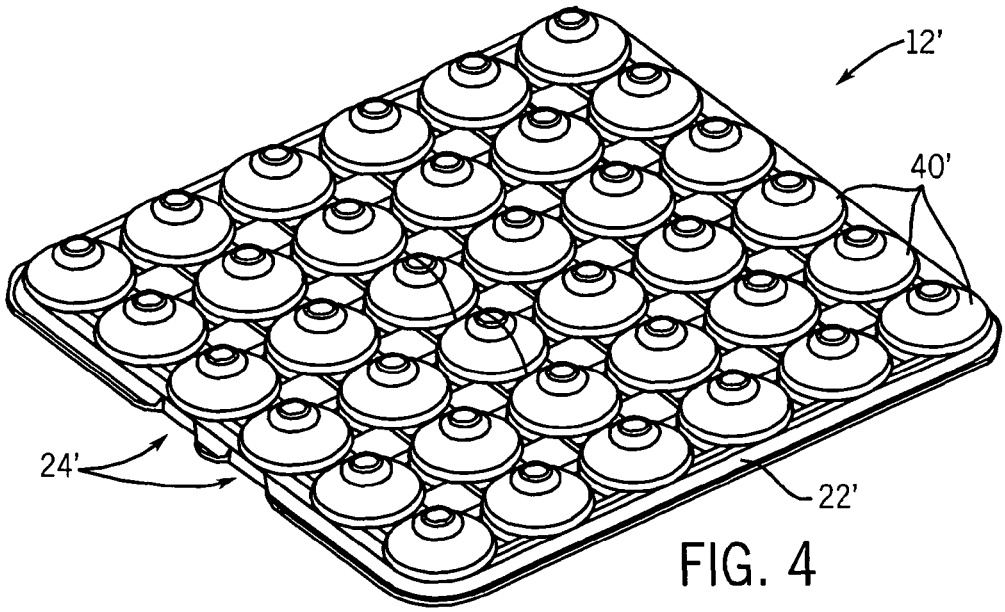
FIG. 4 is an alternate configuration of the nestable egg tray lid according to the invention.

FIG. 4 is an alternate configuration of the nestable packaging lid 12' designed for accommodating thirty-six eggs (a 6 by 6 lid configuration). Consequently, a 36 count packaging base (not shown) would be used along with the packaging lid 12', and then the two would be secured together to form a packaging system as described above. Such a 36 count item packaging system also can nest with other 36 count packaging systems. But in an embodiment, such a stack of 36 count packaging systems would include an offset, in which the pocket of the uppermost packaging system sits on an edge post of an underlying packaging system. In this case, the plurality of nesting packaging systems would not form a completely square stack for shipping purposes, but twenty percent more eggs could still be stacked in a retail store display in the same volume as conventional 30 count trays. The 36 count packaging systems can be stacked straight up on top of one another, rather than by nesting, at the discretion of the retailer.

As explained above with regard to the embodiment of FIGS. 1 to 3D, one packaging system 10 can be seated or placed to "nest" on a second packaging system by rotating the second packaging system approximately ninety degrees to allow the pockets of the overlying packaging system to nest between the dome expansions of the underlying packaging system, and generally on top of the posts of the underlying packaging system. The result is a very compact stacking of packaging systems because a portion of the pockets of each packaging system rests inside the expansions of the underlying packaging system. Therefore, the total package height is reduced by approximately 35 percent as compared to a conventional product package. This permits an egg producer, for example, to place a higher volume of product on each pallet for shipment, and allows a retailer to place more product in the same shelf space. It is also noted that a greater number of items can be stored within the present packaging system than most currently used trays that use a single-face corrugated sleeve. In fact, due to the nesting capabilities of the present packaging system, a retailer can place between about 20 percent to about 30 percent more items on the retail shelf in the same amount of space used by conventional trays.

The combination of a packaging base and the present nestable packaging lid promotes increased stability, better egg protection, and provides increased efficiencies as compared to conventional trays, for an improved packaging system. The nestable packaging lid further allows the eggs to be fully covered and protected from contamination, tampering, and damage by overlying packaging systems. Yet further, the packaging lid is designed to mate with existing, conventional packaging bases.

While the disclosed nestable packaging lids have been shown and described with reference to the illustrated embodiments, those of ordinary skill in the art will recognize and/or be able to ascertain many equivalents to those embodiments. Such equivalents are encompassed by the scope of the present disclosure and the appended claims.

Unless otherwise provided, when the articles "a" or "an" are used herein to modify a noun, they can be understood to include one or more than one of the modified noun.

What is claimed is:

1. A nestable packaging lid, comprising:

a generally planar lid member having an upper surface and a lower surface;

a plurality of dome expansions extending upwardly from the lid member, each dome expansion having a semi-spherical or parabolic shape defining a downwardly facing recess and including a base perimeter defining a base center, each dome expansion further having a frusto-conical-shaped extension disposed on a top portion thereof, the dome expansions being arranged in longitudinal rows and transverse columns to define spaces therebetween on the upper surface of the generally planar lid member; and a plurality of elongate projections extending downwardly from the lower surface of the lid member, at least one projection disposed transversely between a longitudinally adjacent pair of dome expansions and at least one projection disposed longitudinally between a transversely adjacent pair of dome expansions, the at least one projection having a length with a midpoint aligned generally with the base centers of the pair of adjacent dome expansions, the at least one projection further having a height and a varied width, the varied width of the at least one projection increasing with increasing distance from the midpoint.

2. The nestable packaging lid of claim 1, wherein the at least one projection has a height of between about one-sixteenth of an inch and about one-quarter of an inch.

3. The nestable packaging lid of claim 1, wherein a support area is defined on the lower surface of the lid member between diagonally adjacent pairs of dome expansions.

4. The nestable packaging lid of claim 3, wherein the support area is free of projections.

5. The nestable packaging lid of claim 1, wherein the plurality of projections are disposed between each pair of adjacent dome expansions in each longitudinal row and between each pair of adjacent dome expansions in each transverse column.

6. The nestable packaging lid of claim 1, wherein each dome expansion is disposed adjacent to at least one longitudinal projection and to at least one transverse projection.

7. The nestable packaging lid of claim 1, wherein the frustoconical-shaped extension further comprises at least one of a flat top surface or a concave top surface.

8. The nestable packaging lid of claim 1, wherein the plurality of dome expansions include an integral multiple of six dome expansions.

9. The nestable packaging lid of claim 1, wherein the plurality of dome expansions include at least five longitudinal rows of dome expansions, and at least five transverse columns of dome expansions.

10. The nestable packaging lid of claim 1, further comprising a rim extending from a periphery of the lid member.

11. The nestable packaging lid of claim 10, wherein at least one recess is defined in an edge of the rim.

12. The nestable packaging lid of claim 1, wherein the lid member is formed from at least one of a polymeric foam and a molded fiber material.

13. The nestable packaging lid of claim 12, wherein the lid member is formed of polystyrene.

14. The nestable packaging lid of claim 1, wherein the length of the projection is less than the width of the dome expansion.

15. The nestable packaging lid of claim 1, wherein each dome expansion defines a first opening angle at the base perimeter and the frustoconical-shaped extension defines a second opening angle, wherein the first opening angle is greater than the second opening angle.

16. A packaging system comprising:

a nestable packaging lid including a generally planar lid member having an upper surface and a lower surface, a plurality of dome expansions extending upwardly from the lid member, each dome expansion having a semi-spherical or parabolic shape defining a downwardly facing recess and including a base perimeter and a base center, each dome expansion further having a frustoconical-shaped extension disposed on a top portion thereof, the dome expansions being arranged in longitudinal rows and transverse columns to define spaces therebetween on the upper surface of the generally planar lid member, and a plurality of elongate projections extending downwardly from the lower surface of the lid member, at least one projection disposed transversely between a longitudinally adjacent pair of dome expansions and at least one projection disposed longitudinally between a transversely adjacent pair of dome expansions, the at least one projection having a length with a midpoint aligned generally with the base centers of the pair of adjacent dome expansions, the at least one projection further having a height and a varied width, the varied width of the at least one projection increasing with increasing distance from the midpoint; and a nestable packaging base including a base member having an upper surface and a lower surface, a plurality of pockets defined in the base member, each pocket disposed for alignment with a corresponding dome expansion of an overlying nestable packaging lid, and a plurality of posts extending upwardly from the base member, each post disposed between a diagonally adjacent pair of pockets, the posts configured to support an overlying nestable packaging lid, wherein the lower surface of the pockets are configured to be received within the spaces defined between the dome expansions of an underlying nestable packaging lid.

17. The packaging system of claim 16, wherein the nestable packaging lid further comprises a rim extending from a periphery of the lid member and the nestable packaging base further comprises a flange extending from a periphery of the base member, the plurality of posts supporting an overlying nestable packaging lid with the rim in a spaced relationship relative to the flange about the entire periphery of the lid member.

18. The packaging system of claim 17, wherein at least one recess is defined in an edge of the rim and at least one corresponding recess is defined in an edge of the flange.

19. The packaging system of claim 16, wherein the nestable packaging lid further includes a support area defined on the lower surface of the lid member between diagonally adjacent pairs of dome expansions, the support area being free of projections and aligned to receive a top surface of a corresponding post of an underlying nestable packaging base.

20. The packaging system of claim 16, further comprising a wrap material surrounding and securing the nestable packaging lid and the nestable packaging base together.

21. The packaging system of claim 16, wherein the pockets of the nestable packaging base nest between dome expansions of an underlying lid of a second packaging system of similar configuration when the underlying lid of the second packaging system is rotated 90 degrees relative to the nestable packaging base.

22. The packaging system of claim 16, wherein each dome expansion defines a first opening angle at the base perimeter and the frustoconical-shaped extension defines a second opening angle, wherein the first opening angle is greater than the second opening angle.

23. A stack of nested packaging systems comprising:

a first packaging system and an underlying second packaging system, each packaging system comprising:

a nestable packaging lid including a generally planar lid member having an upper surface and a lower surface, a plurality of dome expansions extending upwardly from the lid member, each dome expansion having a semi-spherical or parabolic shape defining a downwardly facing recess and including a base perimeter and a base center, each dome expansion further having a frustoconical-shaped extension disposed on a top portion thereof, the dome expansions being arranged in longitudinal rows and transverse columns to define spaces therebetween on the upper surface of the generally planar lid member, and a plurality of elongate projections extending downwardly from the lower surface of the lid member, at least one projection disposed transversely between a longitudinally adjacent pair of dome expansions and at least one projection disposed longitudinally between a transversely adjacent pair of dome expansions, the at least one projection having a length with a midpoint aligned generally with the base centers of the pair of adjacent dome expansions, the at least one projection further having a height and a varied width, the varied width of the at least one projection increasing with increasing distance from the midpoint; and a nestable packaging base including a base member having an upper surface and a lower surface, a plurality of pockets defined in the base member, each pocket disposed for alignment with a corresponding dome expansion of an overlying nestable packaging lid, and a plurality of posts extending upwardly from the base member, each post disposed between a diagonally adjacent pair of pockets, the posts configured to support an overlying nestable packaging lid, wherein the lower surface of the pockets are configured to be received within the spaces defined between the dome expansions of an underlying nestable packaging lid, wherein the second packaging system is rotated 90 degrees relative to the first packaging system, and the pockets of the nestable packaging base of the first packaging system nest between the dome expansions of the nestable packaging lid of the second packaging system.

24. The stack of claim 23, wherein the nestable packaging lid of each packaging system further comprises a rim extending from a periphery of the lid member and the nestable packaging base of each packaging system further comprises a flange extending from a periphery of the base member, the plurality of posts supporting the overlying nestable packaging lid with the rim in a spaced relationship relative to the flange about the entire periphery of the lid member.

25. The stack of nested packaging systems of claim 23, wherein each dome expansion defines a first opening angle at the base perimeter and the frustoconical-shaped extension defines a second opening angle, wherein the first opening angle is greater than the second opening angle.

* * * * *